US005305949A

United States Patent [19]

Linden

[11] Patent Number: 5,305,949

[45] Date of Patent: Apr. 26, 1994

[54] FOLDABLE, EASILY-DISPOSABLE PIZZA BOX, AND METHODS OF MAKING AND USING SAME

[76] Inventor: Gerald E. Linden, 1535 Ensenda St., Orlando, Fla. 32822

[21] Appl. No.: 997,114

[22] Filed: Dec. 24, 1992

Related U.S. Application Data

[63] Continuation of Ser. No. 813,961, Dec. 24, 1991, abandoned.

[51] Int. Cl.[5] ..... B65D 5/10

[52] U.S. Cl. ..... 229/117.01; 229/930

[58] Field of Search ..... 229/117.01, 117.05, 229/240, 241, 242, DIG. 4

[56] References Cited

U.S. PATENT DOCUMENTS

| | | | |
|---|---|---|---|
| D. 274,889 | 7/1984 | Sullivan | D9/426 |
| D. 292,176 | 10/1987 | Kuerti | D9/428 |
| 1,597,251 | 8/1926 | Shill | 229/117.06 |
| 1,939,745 | 12/1933 | Wellman | 229/117.01 |
| 2,152,079 | 3/1939 | Mott | 229/242 |
| 2,293,060 | 8/1942 | Hothersall | 229/51 |
| 3,161,336 | 12/1964 | Loescher | 229/242 |
| 3,638,852 | 2/1972 | Solanka | 229/117.01 |
| 3,650,383 | 3/1972 | Nigro | 206/45.31 |
| 3,756,471 | 9/1973 | Wissman | 229/242 |
| 3,901,432 | 8/1975 | Lancaster | 229/23 R |
| 3,949,933 | 4/1976 | Giambrone et al. | 229/50 |
| 4,058,214 | 11/1977 | Mancuso | 206/545 |
| 4,091,718 | 5/1978 | Thornhill | 93/39.1 R |
| 4,265,393 | 5/1981 | Orchard | 229/40 |
| 4,358,049 | 11/1982 | Kupersmit | 229/117.07 |
| 4,360,107 | 11/1982 | Roccaforte | 206/636 |
| 4,365,738 | 12/1982 | Densen | 229/23 |
| 4,377,917 | 3/1983 | Guidry | 229/117.01 |
| 4,396,146 | 8/1983 | Sieffert | 229/41 |
| 4,405,077 | 9/1983 | Kupersmit | 229/41 R |
| 4,410,129 | 10/1983 | Wischusen, III | 229/117.05 |
| 4,441,626 | 4/1984 | Hall | 220/443 |
| 4,472,896 | 9/1984 | Brauner et al. | 40/312 |
| 4,476,989 | 10/1984 | Larsen | 220/4 |
| 4,488,659 | 12/1984 | Jones | 220/416 |
| 4,552,269 | 11/1985 | Chang | 206/632 |
| 4,567,341 | 1/1986 | Brown | 219/10.55 |
| 4,572,423 | 2/1986 | Spencer | 229/28 R |
| 4,588,081 | 5/1986 | Newsome et al. | 206/251 |
| 4,623,074 | 11/1986 | Dearwester | 229/242 |
| 4,630,735 | 12/1986 | Jebens | 229/242 |
| 4,671,450 | 6/1987 | Lopez | 229/27 |
| 4,697,731 | 10/1987 | Snyder | 229/23 R |
| 4,700,862 | 10/1987 | Carter et al. | 220/6 |
| 4,711,390 | 12/1987 | Andrews et al. | 229/41 R |
| 4,765,534 | 8/1988 | Zion et al. | 229/109 |
| 4,804,136 | 2/1989 | Hall | 229/112 |
| 4,804,137 | 2/1989 | Harby | 229/114 |
| 4,838,444 | 6/1989 | Bitel | 220/4 |
| 4,848,543 | 7/1989 | Doboze | 206/45.32 |
| 4,934,586 | 7/1990 | Kadien | 229/117.14 |
| 4,944,405 | 7/1990 | Buford et al. | 229/240 |
| 4,944,452 | 7/1990 | Kent et al. | 229/120.21 |
| 4,957,237 | 9/1990 | Madonna et al. | 229/120 |
| 4,960,238 | 10/1990 | Lorenz | 229/125.29 |
| 4,979,667 | 12/1990 | Seaman | 229/114 |
| 4,981,255 | 1/1991 | Schulz | 229/117.22 |
| 4,984,734 | 1/1991 | Zion et al. | 229/109 |
| 5,014,907 | 5/1991 | Hollander et al. | 229/117.01 |

*Primary Examiner*—Allan N. Shoap
*Assistant Examiner*—Christopher McDonald
*Attorney, Agent, or Firm*—Gerald E. Linden

[57] ABSTRACT

At least one sidewall panel of a pizza box blank is provided with at least one removable punch-out section. For disposing of the assembled (inter-folded) pizza box, the punch-out section is removed, and the assembled box is folded in half to diminish a major dimension thereof. Additionally, a series of weakening lines are provided which allow the punched out sidewall panel to deform inwardly, into the assembled box, for further facilitating easy folding for disposal in a trash receptacle.

16 Claims, 7 Drawing Sheets

FOLDABLE, EASILY-DISPOSABLE PIZZA BOX, AND METHODS OF MAKING AND USING SAME

CROSS-REFERENCE TO RELATED APPLICATIONS

This is a continuation of copending U.S. patent application Ser. No. 07/813,961, filed Dec. 24, 1991 by Linden.

TECHNICAL FIELD OF THE INVENTION

The invention relates to containers, especially pizza boxes, which are constructed from a blank (single inter-foldable piece) of stiff paperboard, especially cardboard, and including corrugated cardboard.

BACKGROUND OF THE INVENTION

Take-out pizza is typically contained in a cardboard box. The pizza box is often constructed of a single, flat piece ("blank") of cardboard that has been pre-stressed along a matrix of fold lines, and is assembled (inter-folded) into a box structure by folding various panels, sidewalls, flaps and tabs of the blank along these fold lines and inserting the tabs into slits made in the cardboard. The resulting box (container) is relatively long and wide (major dimensions), nominally square (on the order of twelve to twenty inches in each of the length and width dimensions) to contain a round pizza, and has a relatively shallow depth (minor dimension, on the order of one and three-quarter inches). The resulting container structure is very rigid so that it can maintain its box structure shape, so that it can be carried by its edges, and so that multiple containers (pizza boxes) can be stacked one atop the other without deformation.

The sidewall panels of the box are initially somewhat flexible, depending upon the (paper) stock used for the box blank. However, when the blank is inter-folded, or assembled into a box structure, the sidewall panels, especially the rear sidewall panel connecting the top "lid" panel to the bottom "tray" panel, become rather rigid structural members. In essence, the sidewalls of the container form "trusses".

An assembled pizza box is relatively large (e.g., 12–20 inches) when compared with an opening in a trash receptacle (container). Hence, it is difficult to fit the assembled pizza box into the trash receptacle, since the "major" dimensions (length and width) of the box usually exceed the size of the opening in the trash receptacle. And, after the pizza box is deposited into the trash receptacle, it usually takes up an inordinate amount of space therein, seriously adversely affecting the remaining space in the trash receptacle for other garbage.

One way of making a pizza box fit more easily into a trash receptacle is to fold the box at least once (lengthwise or widthwise) so that it is only half of its original, assembled size (i.e., one of the "major" dimensions is reduced by half). However, the inherent structural rigidity of the assembled (inter-folded) pizza box makes it rather difficult to fold in half. This is especially true when the box is formed from a corrugated cardboard blank.

In order to fold the assembled box in half, it is usually necessary to grasp opposing edges of the box and fold the box about a stationary point, such as one's knee, the edge of a table, or the like. This is a terrible nuisance, especially when the box has become contaminated with excess foodstuff, such as oil, from the pizza.

It is also possible to cut the assembled pizza box into smaller pieces, so that each piece fits easily into the opening of a trash receptacle. This is better than folding in that many small pieces can be formed, but is worse than folding in that excess foodstuff within the box is no longer contained.

What is needed is a pizza box that is easy to fold or otherwise deform into a smaller size (or into several smaller size pieces) for easy disposal thereof in a trash receptacle having an opening smaller than the length or width dimension of the assembled pizza box.

U.S. Pat. No. 4,984,734 discloses a stackable articulated carton tray for flat food products, especially pizza pies. The patent discloses "panels", "fold edges", "sidewalls" and interlocking "flaps".

U.S. Pat. No. 4,979,667 discloses a pizza "tray" and "lid", prepared from a single "blank" of "paperboard" or the like.

U.S. Pat. No. 4,960,238 discloses a 2-Piece Pizza Box with cut-out corners. The cut-out corner sections provide for inward flexibility of the tray sidewalls when a cover panel is fitted over the tray panel.

U.S. Pat. No. 4,944,452 discloses a multiple pizza container formed of a single double-sided corrugated blank including a matrix of "score" and "fold" lines to enable interfolding of the blank.

U.S. Pat. Nos. 4,567,341, 4,476,989, 4,360,107, 4,058,214, 3,650,383, Des. 292,176 and Des. 274,889 disclose additional pizza boxes and containers.

These references are cited, generally, as indicative of the state of the art in pizza boxes, and for establishing a lexicon of commonly-used terminology. None of the above-referenced pizza boxes and containers appear to provide means for deforming or otherwise altering an assembled box having relatively large dimensions for easy disposal in a trash receptacle having a relatively smaller opening.

DISCLOSURE OF THE INVENTION

It is therefore an object of the present invention to provide a technique for enabling a user to easily fold an assembled pizza box in half, or in thirds, thereby diminishing its overall dimension to more readily fit into an opening of a trash receptacle.

It is a further object of the invention to provide a mechanism, integral with the pizza box, for substantially weakening the structural rigidity of at least the rear sidewall panel of the assembled pizza box.

According to the invention, at least one sidewall panel of a pizza box blank is provided with at least one punch-out section. The punch-out section is formed by perforated lines, and is preferably located midway along the extent of the sidewall. In the case of two punch-out sections on a sidewall panel, the punch-out sections are preferably located at points dividing the sidewall panel into three substantially equal length sections.

Preferably, the rear sidewall panel of the pizza box is provided with at least one punch-out section.

Two opposite sidewall panels may each be provided with a corresponding number of at least one punch-out sections. The alternate opposite sidewalls may also be provided with punch-out sections.

The pizza box blank is provided with pre-stressed fold lines for facilitating inter-folding the blank into a box structure.

In order to facilitate disposal of the assembled pizza box, the punch-out sections are punched out. This has the effect of substantially weakening the structural rigidity of the sidewall panel.

Next, the pizza box is grasped by the alternate opposite sides, and the box is folded along a line (or lines) defined by corresponding punch-out sections on the opposite sides of the box. This has the effect of reducing at least one major dimension of the pizza box by a factor of two, for two opposing punch-out sections (one on each of the opposite sidewall panels), or by a factor of three, for four opposing punch-out sections (two on each of the opposite sidewall panels).

Preferably, the sidewall panels having punch-out sections are the opposite front and rear sidewalls of the pizza box. In a one-piece construction, the rear sidewall panel connects a top "tray" panel to a bottom "lid" panel, and forms a hinge for the lid panel, and the front sidewall may be provided with a locking tab for securing the lid panel over the tray panel.

In an alternate embodiment of the invention, the punch-out sections are provided with "tabs" extending from the punch-out sections. The tabs are grasped and pulled to cause the tear-out section to tear out.

According to a feature of the invention, the blank is pre-stressed along a matrix of weakening lines, other than the lines operative in inter-folding (assembling the box). These weakening lines facilitate folding the assembled box.

Other objects, features and advantages of the invention will become apparent in light of the following description thereof.

DETAILED DISCLOSURE OF THE INVENTION

FIG. 1—Prior Art

Figure 1:
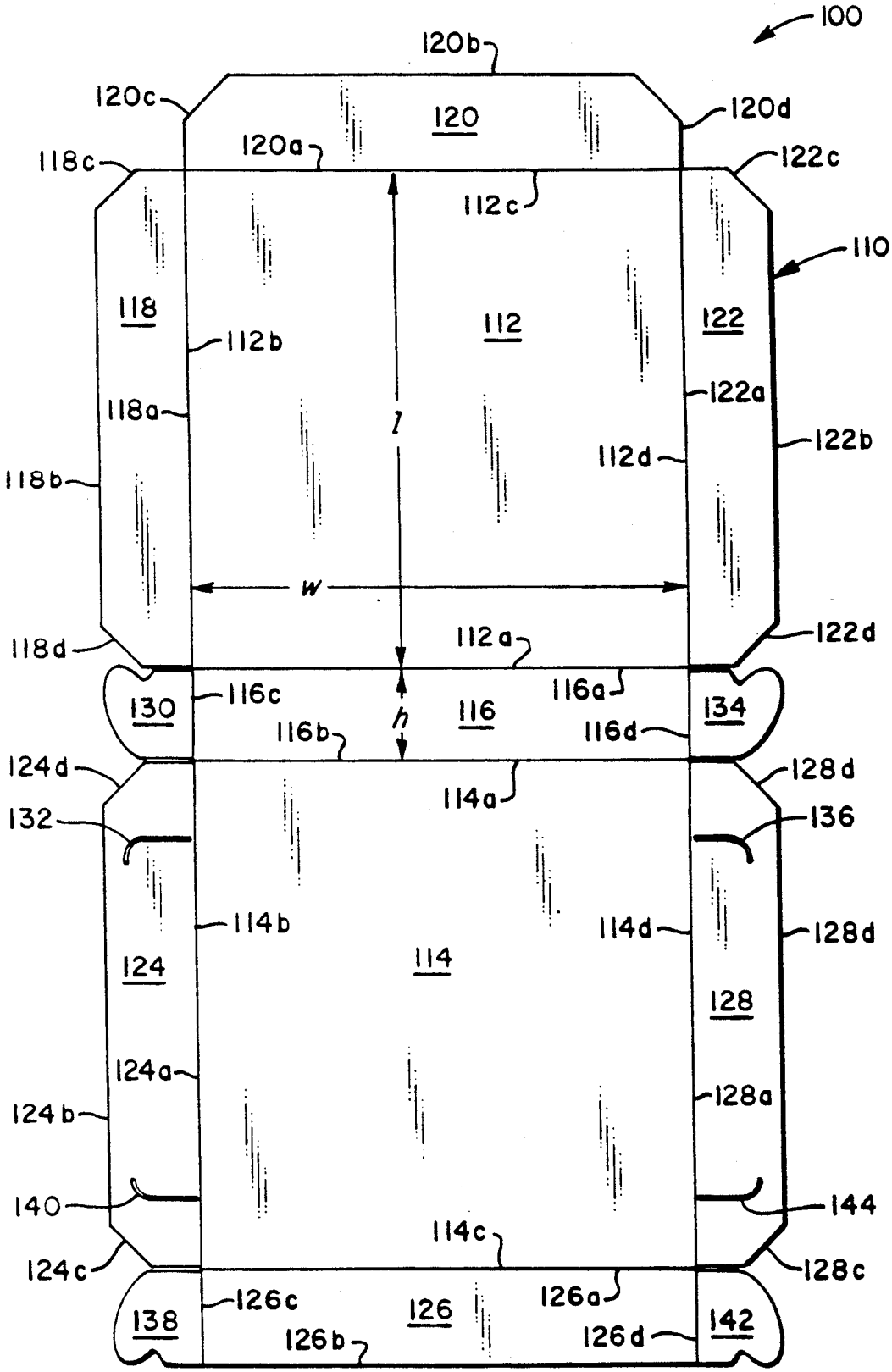
FIG. 1 PRIOR ART
FIG. 1 is a plan view of a prior art pizza box, which is initially a flat piece (blank) of paperboard, such as cardboard or corrugated cardboard, and which is later assembled (folded) into the shape of a container.

FIG. 1 shows a typical prior art pizza box 100. The box is formed of a single, flat piece of cardboard 110, which is cut and pre-stressed along a matrix of fold lines to be assembled (inter-folded) into a relatively wide and long, and relatively short, container, as follows.

A top "lid" panel 112 is defined by four pre-stressed fold lines 112*a*, 112*b*, 112*c* and 112*d*. The four fold lines are arranged as a square. The fold lines 112*a*, 112*b*, 112*c* and 112*d* form a rear edge, side edge, front edge and opposite side edge of the top panel, respectively. The top panel has a length dimension "l" (lower case "L"), defined by the distance between the front 112*c* and rear 112*a* edges of the top panel, and has a width dimension "w" defined by the distance between the opposite side edges 112*b* and 112*d* of the top panel. Typically, the top panel is square (i.e., w=l).

Similarly, a bottom "tray" panel 114 is defined by four pre-stressed fold lines 114*a*, 114*b*, 114*c* and 114*d*. The four fold lines are arranged as a square. The fold lines 114*a*, 114*b*, 114*c* and 114*d* form a rear edge, side edge, front edge and opposite side edge of the bottom panel, respectively. The bottom panel has a length dimension "l", defined by the distance between the front 114*c* and rear edges 114*a* of the bottom panel, and has a width dimension "w" defined by the distance between the opposite side edges 114*b* and 114*d* of the bottom panel. Typically, the bottom panel is square (i.e., w=l).

A rear sidewall panel 116 is formed between the rear edges 112*a* and 114*a* of the top and bottom panels 112 and 114, respectively. The rear sidewall panel 116 has a top edge 116*a* coincident with the rear edge 112*a* of the top panel, and has a bottom edge 116*b* coincident with the rear edge 114*a* of the bottom panel 114. The rear sidewall panel 116 is rectangular, as defined by the aforementioned top and bottom edges 116*a* and 116*b*, respectively, and by opposite side edges 116*c* and 116*d* formed by pre-stressed lines. The back sidewall panel has a width dimension "w" defined by the distance between the opposite side edges 116*c* and 116*d*, and has a height dimension "h" defined by the distance between the top and bottom edges 116*a* and 116*b*.

When the box 100 is inter-folded (assembled) into a box structure, the rear sidewall panel 116 forms a rigid rear sidewall of the box.

A top left side flap 118 is formed at the left side edge 112*b* of the top panel 112, and has a length (1) and a height (h). The top left side flap 118 has four edges: a top edge 118*a*, a bottom edge 118*b*, a front edge 118*c* and a back edge 118*d*. The top edge 118*a* of the top left side flap 118 is a pre-stressed line coincident with the left side edge 112*b* of the top panel 112.

A top front flap 120 is formed at the front edge 112*c* of the top panel 112, and has a width (w) and a height (h). The top front flap 120 has four edges: a top edge 120*a*, a bottom edge 120*b*, and two opposite side edges 120*c* and 120*d*. The top edge 120*a* of the top front flap 120 is a pre-stressed line coincident with the front edge 112*c* of the top panel 112.

A top right side flap 122 is formed at the right side edge 112*d* of the top panel 112, and has a length (1) and a height (h). The top fight side flap 122 has four edges: a top edge 122*a*, a bottom edge 122*b*, a front edge 122*c* and a back edge 122*d*. The top edge 122*a* of the top right side flap 122 is a pre-stressed line coincident with the right side edge 112*d* of the top panel 112.

A bottom left side flap 124 is formed at the left side edge 114*b* of the bottom panel 114, and has a length (1) and a height (h). The bottom left side flap 124 has four edges: a bottom edge 124*a*, a top edge 124*b*, a front edge 124*c* and a back edge 124*d*. The bottom edge 124*a* of the bottom left side flap 124 is a pre-stressed line coincident with the left side edge 114*b* of the bottom panel 114.

A bottom front flap 126 is formed at the front edge 114*c* of the bottom panel 114, and has a width (w) and a height (h). The bottom front flap 126 has a bottom edge 126*a*, a top edge 126*b*, and two opposite side edges 126*c* and 126*d*. The bottom edge 126*a* of the bottom front flap 126 is a pre-stressed line coincident with the front edge 114*c* of the bottom panel.

A bottom right side flap 128 is formed at the right side edge 114*d* of the bottom panel 114, and has a length (l) and a height (h). The bottom right side flap 128 has four edges: a bottom edge 128*a*, a top edge 128*b*, a front edge 128*c* and a back edge 128*d*. The bottom edge 128*a* of the bottom right side flap 128 is a pre-stressed line coincident with the right side edge 114*d* of the bottom panel 114.

Together, when the blank 110 is inter-folded (assembled) into a box structure, the top front flap 120 and bottom front flap 126 form a front sidewall of the assembled box. The top left flap 118 and bottom left flap 124 form a side sidewall of the assembled box. The top right flap 122 and the bottom right flap 128 form another side sidewall of the assembled box. The rear panel 116 forms a very rigid rear sidewall of the assembled box.

Tabs 130 and 134 are formed in the blank 110 at opposite side edges 116*c* and 116*d* of the rear panel 116. Corresponding slits 132 and 136 are formed inward of the rear edges 124*d* and 128*d* of the left and right bottom side panels 124 and 128. In this manner, when the blank 110 is folded into a box structure, the tabs 130 and 134 engage the slits 132 and 136, respectively, to maintain the three-dimensional structure of the box.

Similarly, tabs 138 and 142 are formed in the blank 110 at opposite side edges 126*c* and 126*d* of the bottom front panel 126. Corresponding slits 140 and 144 are formed inward of the front edges 124*c* and 128*c* of the left and right bottom side panels 124 and 128. In this manner, when the blank 110 is folded into a box structure, the tabs 138 and 142 engage the slits 140 and 144, respectively, to maintain the three-dimensional structure of the box.

The structure, and method of assembling a blank into a box, as shown and described with respect to FIG. 1 is set forth as exemplary of pizza box construction. Many variations are known.

In summary, the blank 110 starts out as a flat sheet of paperboard, cardboard, corrugated cardboard, or the like, is cut and pre-stressed along a matrix of fold lines for folding into a rigid three-dimensional carton, such as a pizza box. The resulting container is surprisingly rigid with respect to bending forces applied across any pair of opposite sides, which makes folding the assembled container in half, lengthwise or widthwise, extremely difficult.

It should be understood that the terms "top", "bottom", "left", "right", "front" and "back" are arbitrary designations used only to lend consistency to the description of the various orientations of elements. Generally, "left" is opposite (similar to diametrically opposed) of "right", "top" is opposite of "bottom", "front" is opposite of "rear" (or "back"), etc.

All of the above-described techniques of cutting, pre-stressing and folding are well known in the art to which the present invention pertains.

FIG. 2

Figure 2:
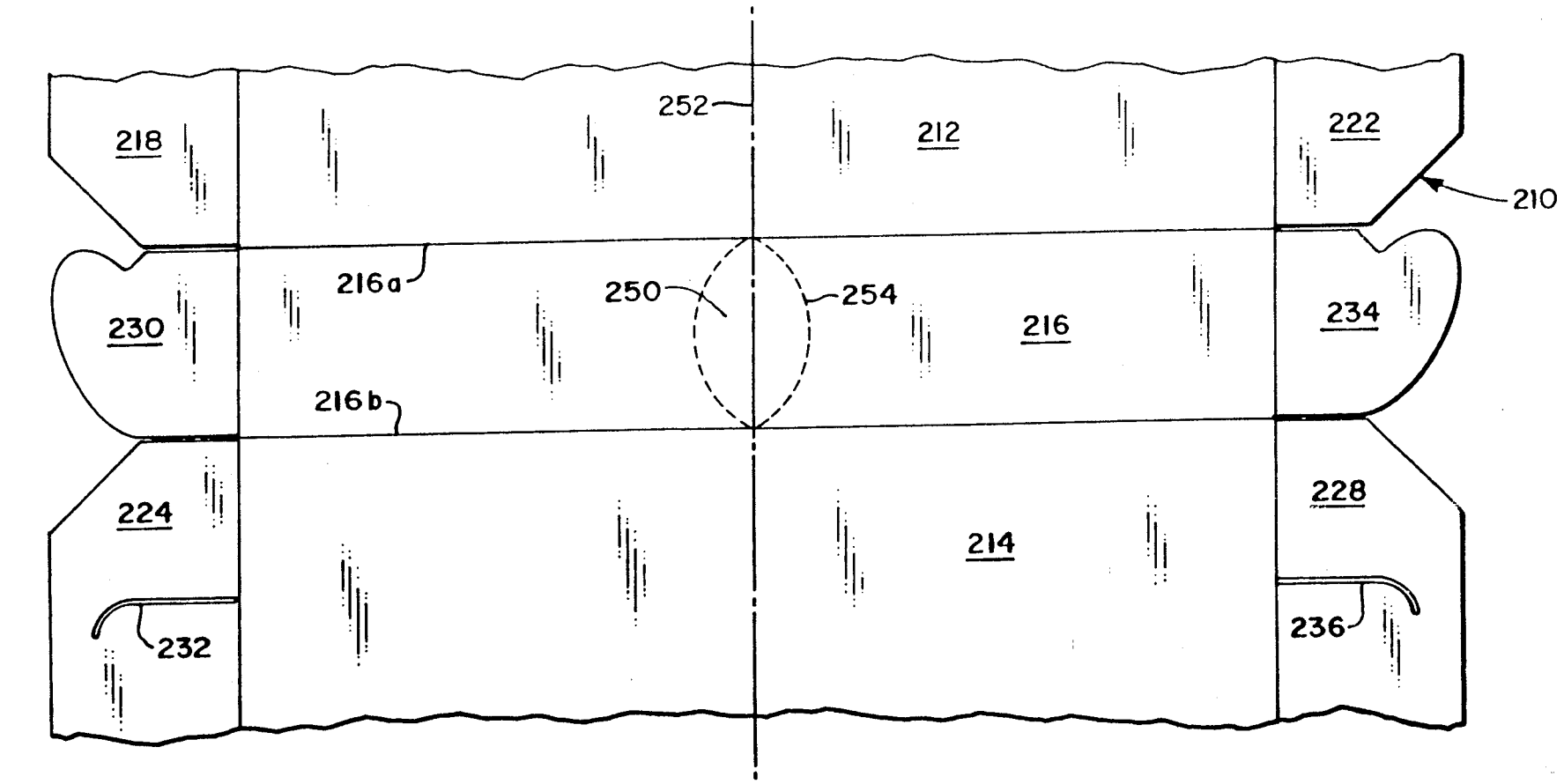
FIG. 2 is a plan view of a relevant portion of the pizza box blank of the present invention, prior to assembly, with a punch-out section located on the rear sidewall panel.

FIG. 2 shows an embodiment of the pizza box 200 of the present invention, prior to folding (assembling).

A rigid blank 210 is cut and prestressed much like was described with respect to the pizza box 100 of FIG. 1. Hence, only a portion of the pizza box 200 need be illustrated.

The blank 210 includes a top panel 212 (corresponding to the top panel 112), a bottom panel 214 (corresponding to the bottom panel 114), a top left side flap 218 (corresponding to the top left side flap 118), a bottom left side flap 224 (corresponding to the bottom left side flap 124), a top right side flap 222 (corresponding to top right side flap 122), a bottom right side flap 228 (corresponding to bottom right side flap 128), tabs 230 and 234 (corresponding to tabs 130 and 134), and slits 232 and 236 (corresponding to slits 132 and 136).

The blank 210 further includes a top front flap (not shown; corresponding to the top front flap 120), and a bottom front flap (corresponding to the bottom front flap 126).

The blank 210 further includes a rear sidewall panel 216, corresponding generally to the rear sidewall panel 116 of the box 100 (FIG. 1).

According to the invention, the rear sidewall 216 is provided with a punch-out section 250 disposed midway along the rear sidewall 216. A line 252 is drawn in the Figure to show how the overall box 200 is divided in half, widthwise.

The punch-out section 250 is formed by a pattern of perforations 254, and has a width dimension (w') substantially less than the overall width (w) of the rear sidewall panel 216 ($w' << w$), and extends from the top edge 216*a* to the bottom edge 216*b* of the rear sidewall 216. A suitable width for the punch-out section 250 is one-half to one and one-half inches.

The perforations 254 extend entirely through the stock of the blank 210, and define metes and bounds of the punch-out section 250.

In use, for disposing of the assembled pizza box 200, the user would press firmly against the punch-out section 250, punching it out (actually, punching the section 250 into the box).

Then, grasping firmly the opposite side edges of the box (e.g., edges 112*b*/114*b* and 112*d* and 114*d*)), the user would fold the box in half, widthwise, along the line 252.

Such folding of the box in half, widthwise, is facilitated by the elimination of material (i.e., the punch-out section 250) from the rear sidewall 216 of the box. Normally, the rear sidewall 216 forms a very rigid truss, resisting efforts to fold the box in half. Removing the punch-out section 250 substantially weakens the rigidity of the rear sidewall 216, and allows for much easier folding of the box.

In this example, only the rear sidewall 216 is provided with a punch-out section 250, and the inter-folded (assembled) box 200 is folded in half, widthwise. In this manner, a major dimension (namely the width) of the box is reduced by a factor of two, for fitting within the opening of a trash receptacle.

While not shown, the top and bottom front flaps (120 and 126) could also be provided with punch-out sections similar to the punch-out section 250, in which case there would be a punch-out section on the rear panel and a punch-out section on the front panel (the front panel is formed by two overlying flaps). These punch-out sections would be aligned along the line 252, and would be on opposite sidewalls of the box.

Similarly, the two side sidewalls could be provided with punch-out sections, aligned along a line dividing the box in half lengthwise. Again, these punch-out sections would be disposed on opposite sidewalls of the box.

FIG. 3

Figure 3:
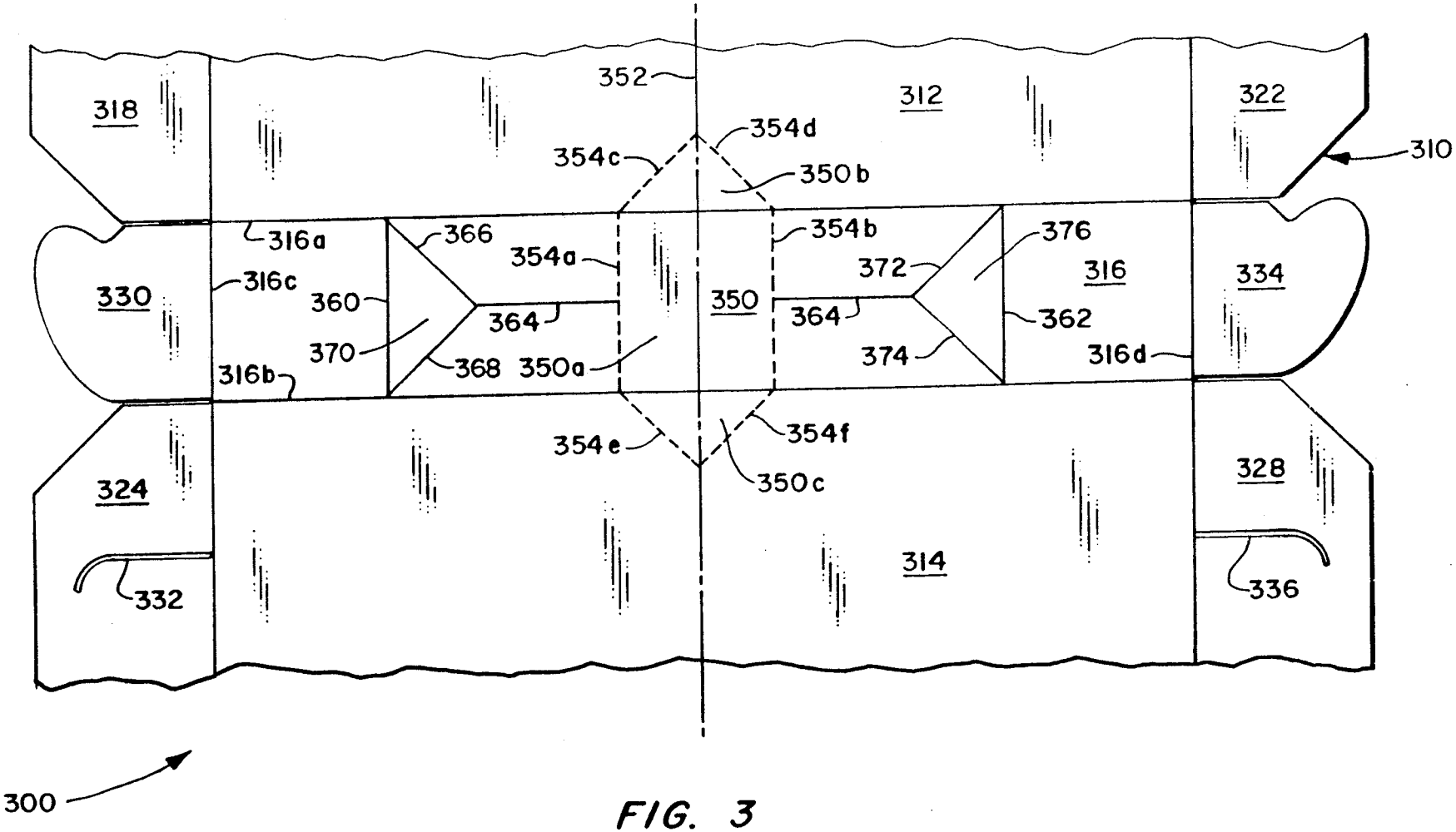
FIG. 3 is a plan view of a relevant portion of the pizza box blank of the present invention, with an enlarged punch-out section and with a matrix of weakening lines located on the rear sidewall panel.

FIG. 3 shows a more extensive version of the single punch-out embodiment of FIG. 2.

A rigid blank 310 is cut and prestressed much like was described with respect to the pizza box 100 of FIG. 1. Hence, only a portion of the pizza box 300 need be illustrated.

The blank 310 includes a top panel 312 (corresponding to the top panel 112), a bottom panel 314 (corresponding to the bottom panel 114), a top left side flap 318 (corresponding to the top left side flap 118), a bottom left side flap 324 (corresponding to the bottom left side flap 124), a top right side flap 322 (corresponding to top right side flap 122), a bottom right side flap 328 (corresponding to bottom right side flap 128), tabs 330 and 334 (corresponding to tabs 130 and 134), and slits 332 and 336 (corresponding to slits 132 and 136).

The blank 310 further includes a top front flap (not shown; corresponding to the top front flap 120), and a bottom front flap (corresponding to the bottom front flap 126).

The blank 310 further includes a rear sidewall panel 316, corresponding generally to the rear sidewall panel 116 of the box 100 (FIG. 1).

According to the invention, the rear sidewall 316 is provided with a punch-out section 350 disposed midway along the rear sidewall 316. A line 352 is drawn in the Figure to show how the overall box 300 is divided in half, widthwise.

The punch-out section 350 is formed by a pattern of perforation lines 354*a*–354*f*, and has a width dimension (w') substantially less than the overall width (w) of the rear sidewall panel 216 (w'<<w). The perforations 354*a*–354*f* extend entirely through the stock of the blank 210, and define metes and bounds of the punch-out section 350. A suitable width for the punch-out section 350 is one-half to one and one-half inches.

In this example, the punch-out section 350 extends beyond the top 316*a* and bottom 316*b* edges of the rear panel 316, into each of the top and bottom panels 312 (corresponding to panels 112 and 212) and 314 (corresponding to panels 114 and 214).

The punch-out section 350 has three parts:

- a first, rectangular part 350*a* disposed entirely on the rear sidewall panel 316 and formed by two parallel perforation lines 354*a* and 354*b*;
- a top triangular part 350*b* extending into the top panel 312, and aligned widthwise with the first part 350*a* and formed by two intersecting perforation lines 354*c* and 354*d*; and
- a bottom triangular part 350*c* extending into the bottom panel 314, and aligned widthwise with the first part 350*a* and formed by two intersecting perforation lines 354*e* and 354*f*.

As illustrated, the perforation lines 354*d* and 354*e* are "extensions" of the perforation line 354*a*, and the perforation lines 354*d* and 354*f* are extensions of the perforation line 354*b*.

To remove the punch-out section 350 from an assembled box, the user would push in on one of the triangular parts (e.g., 350*b*) of the punch-out section, and by pulling on the triangular part would tear the punch-out section 350 from the assembled box.

This has a similar effect as removing the punch-out section 250 (FIG. 2), in that the rigidity of the rear sidewall panel 316 is substantially weakened, but in this case the punch-out section 350 extends into the top and bottom panels, making folding the assembled box even easier.

In order to further facilitate folding the assembled box, the rear sidewall panel 316 is further provided with a series of pre-stressed lines, as follows:

A pre-stressed line 360 extends from the top edge 316*a* to the bottom edge 316*b* of the rear panel 316, at a location distant from and to one side of the centerline 352. A similar, pre-stressed line 362 extends from the top edge 316*a* to the bottom edge 316*b* of the rear panel 316, at a location distant from and to the opposite side of the centerline 352. The lines 360 and 362 are located about half the distance from the centerline 352 to the respective side edges 316*c* and 316*d* of the rear panel 316.

A pre-stressed line 364 extends from a short distance (about one inch) inward (towards the centerline 352) of the line 360 to a short distance inward of the line 362, across the punch-out section 350, at a distance h/2 from either edge 316*a*, 316*b* of the panel, and may be continuous, or dis-continuous at the punch-out section (the line 364 is illustrated dis-continuous).

A pre-stressed line 366 extends from the top end of the line 360 to the left end of the line 364. A pre-stressed line 368 extends from the bottom end of the line 360 to the left end of the line 364. The lines 360, 366 and 368 therefore form a triangular section 370. The triangular section 370 is approximately an equilateral triangle.

A pre-stressed line 372 extends from the top end of the line 362 to the right end of the line 364. A pre-stressed line 374 extends from the bottom end of the line 36 to the right end of the line 364. The lines 362, 372 and 374 therefore form a triangular section 376. The triangular section 376 is approximately an equilateral triangle.

The triangular sections 370 and 376, and the pre-stressed line 364 will allow the rear sidewall panel 316 to deform inwardly (into the assembled box) when the punch-out section 350 is removed and the box is folded along the centerline 352. Thus, the pre-stressed lines of weakening 360, 362, 364, 366, 368, 372 and 374 facilitate folding the assembled box for disposal in a trash receptacle.

FIG. 4

Figure 4:
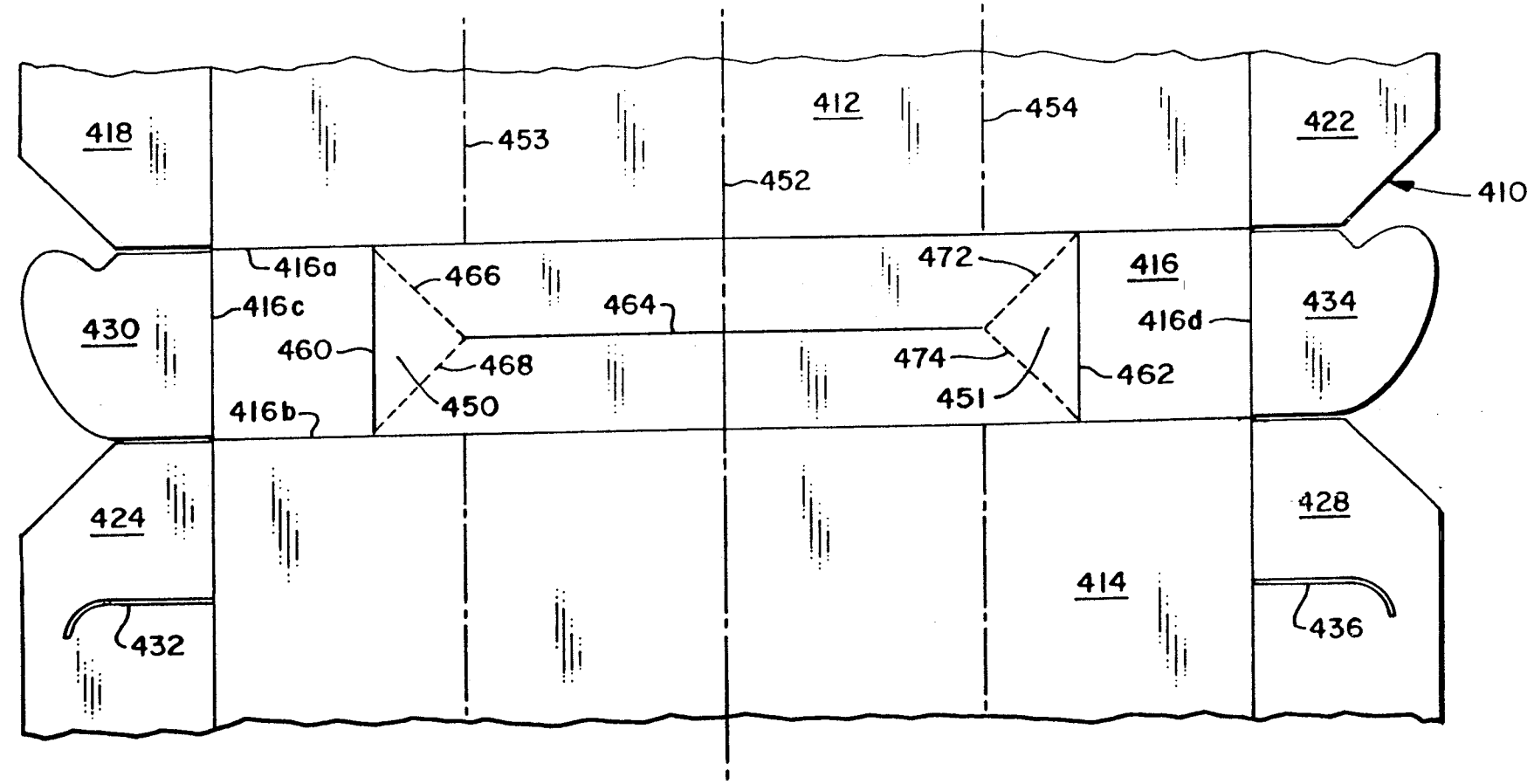
FIG. 4 is a plan view of a relevant portion of the pizza box blank of the present invention, with two punch-out sections and with a matrix (series) of weakening lines located on the rear sidewall panel.

FIG. 4 shows a version of the invention having two punch-out sections on the rear sidewall panel.

A rigid blank 410 is cut and prestressed much like was described with respect to the pizza box 100 of FIG. 1. Hence, only a portion of the pizza box 400 need be illustrated.

The blank 410 includes a top panel 412 (corresponding to the top panel 112), a bottom flap 414 (corresponding to the bottom flap 114), a top left side flap 418 (corresponding to the top left side flap 118), a bottom left side flap 424 (corresponding to the bottom left side flap 124), a top right side flap 422 (corresponding to top right side flap 122), a bottom right side flap 428 (corresponding to bottom right side flap 128), tabs 430 and 434 (corresponding to tabs 130 and 134), and slits 432 and 436 (corresponding to slits 132 and 136).

The blank 410 further includes a top front flap (not shown; corresponding to the top front flap 120), and a bottom front flap (corresponding to the bottom front flap 126).

The blank 410 further includes a rear sidewall panel 416, corresponding generally to the rear sidewall panel 116 of the box 100 (FIG. 1).

According to the invention, the rear sidewall 416 is provided with a punch-out section 450 disposed to one side of the centerline 452, and another punch-out section 451 disposed to an opposite side of the centerline 452.

A pre-stressed line 460 extends from the top edge 416*a* to the bottom edge 416*b* of the rear panel 416, at a location distant from and to one side of the centerline 452. A similar, pre-stressed line 462 extends from the top edge 416*a* to the bottom edge 416*b* of the rear panel 416, at a location distant from and to the opposite side of the centerline 452. The lines 460 and 462 are located about three-quarters the distance from the centerline 452 to the respective side edges 416*c* and 416*d* of the rear panel 416.

A pre-stressed line 464 extends from a short distance (about one inch) inward (towards the centerline 452) of the line 460 to a short distance inward of the line 462, continuously across the rear sidewall panel 416, at a distance h/2 from either edge 416*a*, 416*b* of the panel.

A perforation line 466 extends from the top end of the line 460 to the left end of the line 464. A perforation line 468 extends from the bottom end of the line 460 to the left end of the line 464. The lines 460, 466 and 468 therefore form a triangular punch-out section 450. The triangular section 450 is approximately an equilateral triangle.

A perforation line 472 extends from the top end of the line 462 to the right end of the line 464. A perforation line 474 extends from the bottom end of the line 462 to the right end of the line 464. The lines 462, 472 and 474 therefore form a triangular punch-out section 451. The triangular section 451 is approximately an equilateral triangle.

In use, the punch-out sections 450 and 451 are pushed inward. The assembled box 200 is then grasped at opposite side edges and folded about the centerline 452. The pre-stressed line 464 aids in this folding operation by allowing the rear panel 416 to collapse.

The box 400 may be folded in half, along the line 452. It may also be folded in thirds, along the lines 453 and 454.

FIG. 5

Figure 5:
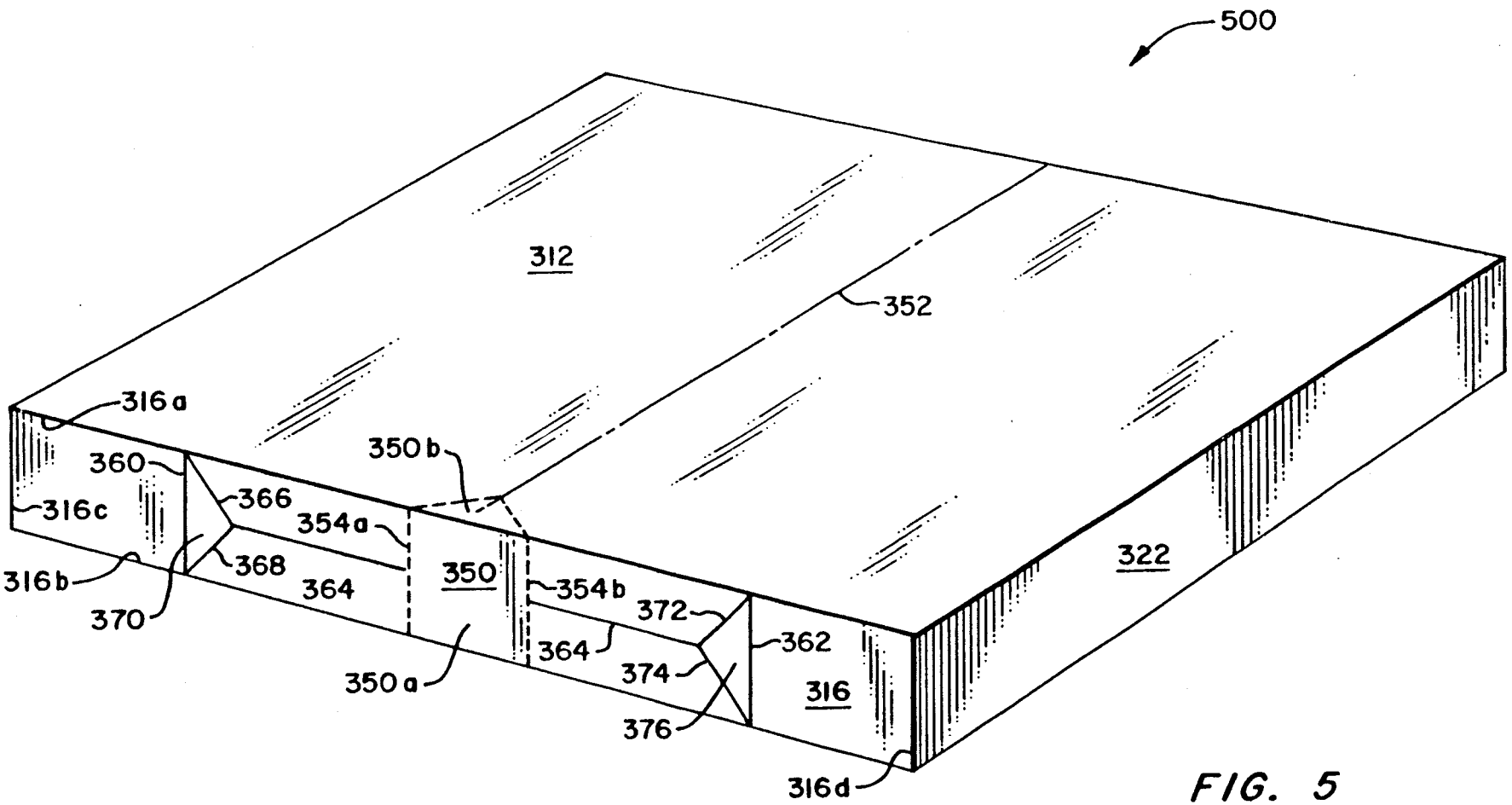
FIG. 5 is a perspective view of a relevant portion of the assembled pizza box of the present invention, with one enlarged punch-out section on the rear panel sidewall.

FIG. 5 is a perspective view of an assembled (interfolded) pizza box 500, according to the present invention. For purposes of this illustration, the embodiment of FIG. 3 is employed.

It is more clearly shown in this view that the centerline about which the box will be folded divides the major width dimension of the box in half.

FIG. 6

Figure 6:
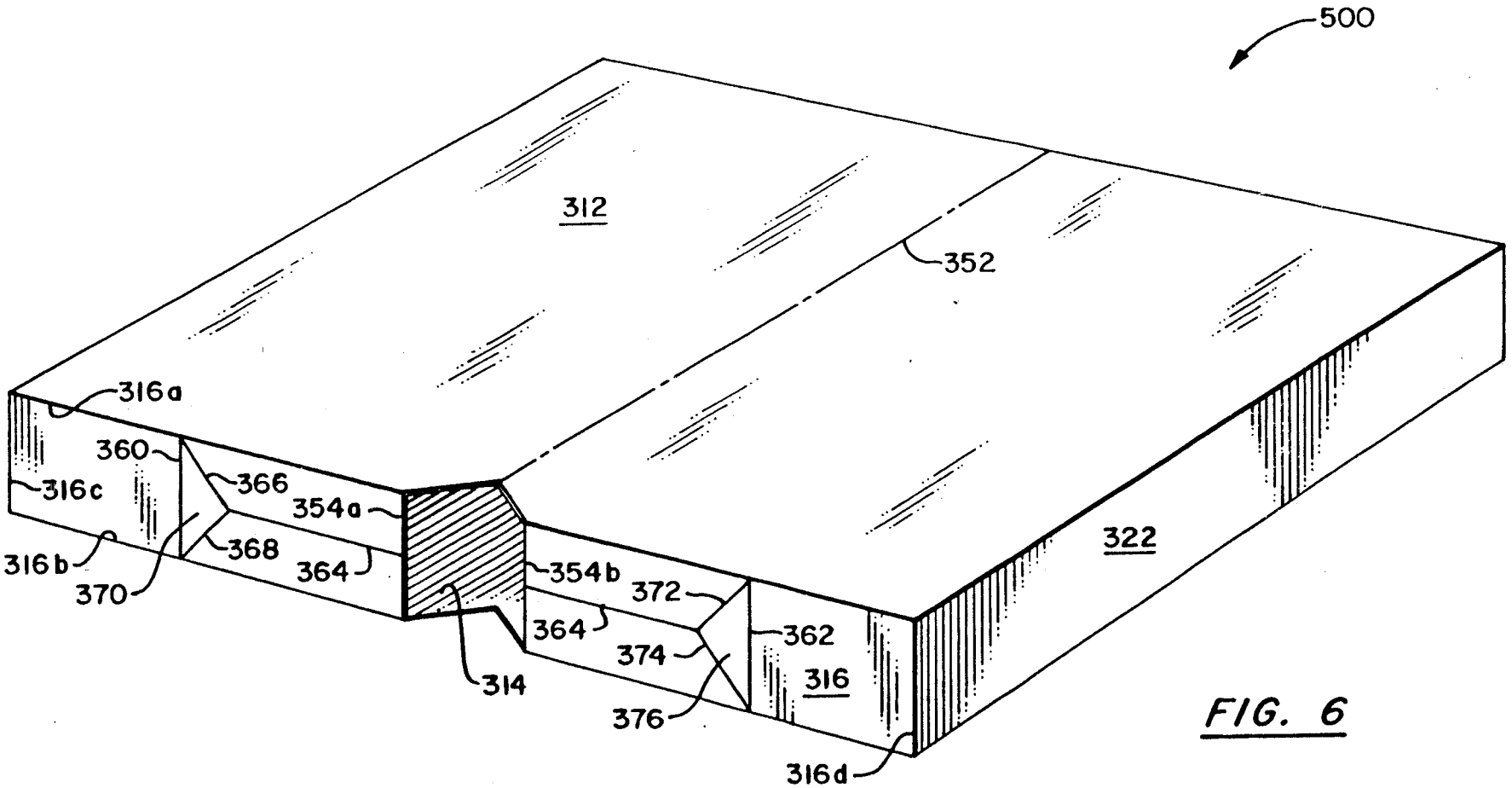
FIG. 6 is a perspective view of a the assembled pizza box shown in FIG. 5, showing the punch-out section punched out.

FIG. 6 is a perspective view of the assembled box 500 of FIG. 5, with the punch-out section 350 already punched out. The inner surface of the bottom tray panel 314 is visible through the opening left behind by the punch-out section.

FIG. 7

Figure 7:
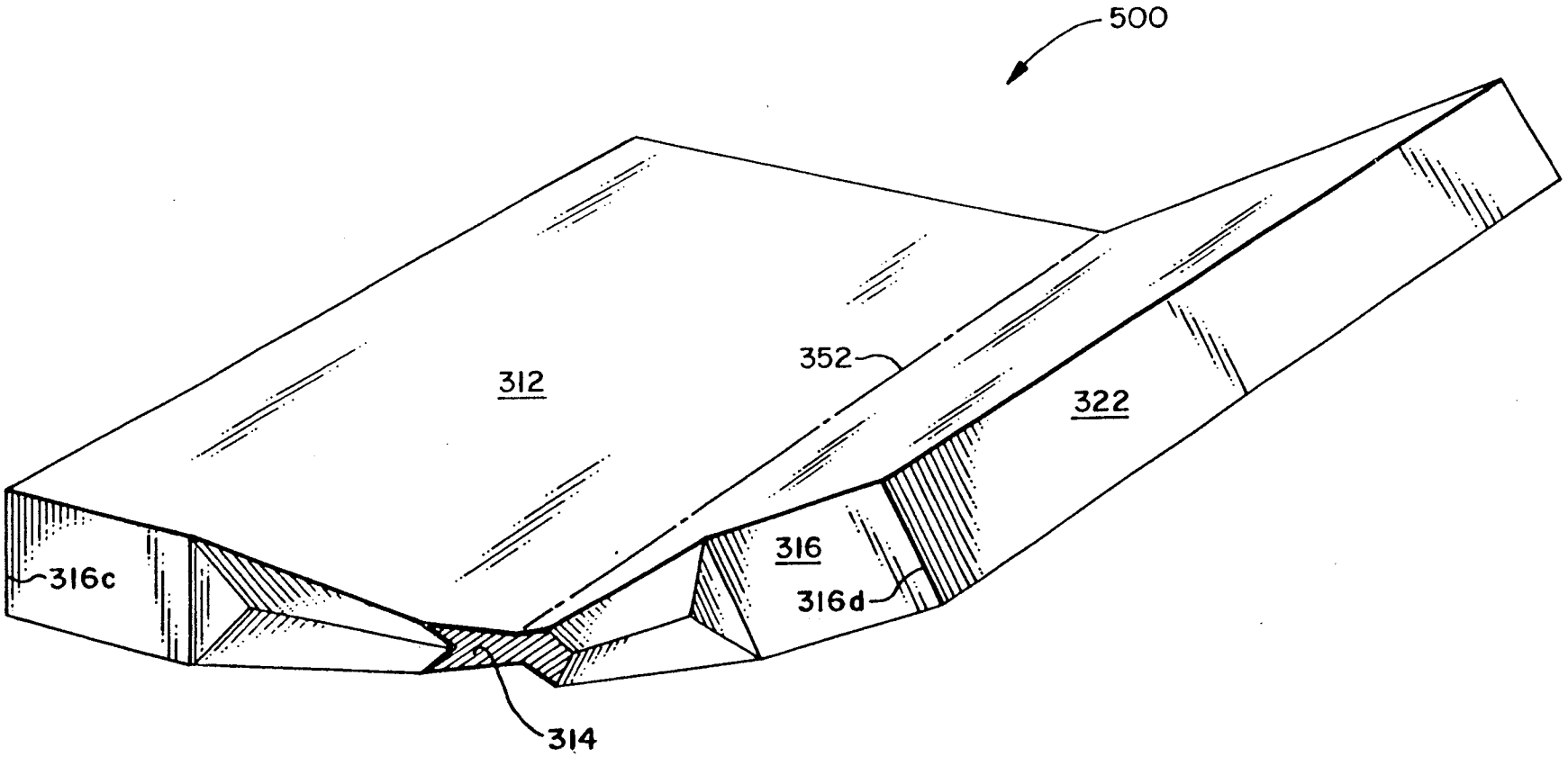
FIG. 7 is a perspective view of the assembled pizza box shown in FIG. 6, showing the pizza box being folded in half.

FIG. 7 is a perspective view of the assembled box 500 of FIG. 5, with the punch-out section 350 already punched out, and in the process of being folded in half for disposal.

It can already be seen in this view how the rear sidewall 316 is collapsing inwardly, following a pattern established by the pre-stressed lines 360, 362, 364, 366, 368, 372 and 374. As the top lid panel 312 "squishes" closer to the bottom tray panel 314, in a region along the centerline 352, folding the assembled box 500 in half becomes extremely easy.

What is claimed is:

1. Pizza box blank comprising:

a blank of paperboard;

a matrix of pre-stressed lines on the blank defining a top lid panel having a length dimension "l" and a width dimension "w", a bottom tray panel having a length dimension and a width dimension substantially equal to the length and width dimensions of the top lid panel, and a rear sidewall panel joining the top lid panel to the bottom tray panel;

the rear sidewall panel having one edge coincident with an edge of the top lid panel;

the rear sidewall panel having an other edge, opposite the one edge, coincident with an edge of the bottom tray panel;

the rear sidewall panel having a width dimension substantially equal to the width dimensions of the top lid and bottom tray panels;

the rear sidewall panel having a height dimension "h" several times smaller than its width dimension and defined as the distance between the one and the other edges of the rear sidewall panel;

at least one punch-out section formed in at least the rear sidewall panel, and extending heightwise at least completely across the rear sidewall panel from the one edge to the other edge of the rear sidewall panel, for facilitating folding an interfolded pizza box formed from the blank;

at least one first weakening lines extending from the at least one punch-out section towards a one end of the rear sidewall panel; and at least one second weakening lines extending from at least one punch-out section towards an other opposite end of the rear sidewall panel.

2. Pizza box blank comprising:

a blank of paperboard;

a matrix of pre-stressed lines on the blank defining a top lid panel having a length dimension "l" and a width dimension "w", a bottom tray panel having a length dimension and a width dimension substantially equal to the length and width dimensions of the top lid panel, and a rear sidewall panel joining the top lid panel to the bottom tray panel;

the rear sidewall panel having one edge coincident with an edge of the top lid panel;

the rear sidewall panel having an other edge, opposite the one edge, coincident with an edge of the bottom tray panel;

the rear sidewall panel having a width dimension substantially equal to the width dimensions of the top lid and bottom tray panels;

the rear sidewall panel having a height dimension "h" several times smaller than its width dimension and defined as the distance between the one and the other edges of the rear sidewall panel;

at least one punch-out section formed in at least the rear sidewall panel, and extending heightwise at least completely across the rear sidewall panel from the one edge to the other edge of the rear sidewall panel, for facilitating folding an interfolded pizza box formed from the blank;

two punch-out sections disposed on the rear sidewall panel on either side of a centerline about which a pizza box assembled from the inter-folded blank is folded, each of the two punch-out sections extending at least completely across the rear sidewall panel from the top lid panel to the bottom tray panel; and at least one weakening line disposed on the rear sidewall panel, extending from a one of the two punch-out sections to an other of the two punch-out sections, for allowing the rear sidewall panel to deflect inward when the punch-out sections are removed from a pizza box assembled from the inter-folded blank, and the assembled pizza box is folded.

3. Pizza box blank for forming an inter-folded pizza box, comprising:

a blank of paperboard;

a top lid panel having four edges, a length dimension "l" between first two opposite of the four edges of the top lid panel, and a width dimension "w" between second two opposite of the four edges of the top lid panel;

a bottom tray panel having four edges, a length dimension between first two opposite of the four edges of the bottom tray panel and substantially equal to the length dimension of the top lid panel, and a width dimension between second two opposite of the four edges of the bottom tray panel and substantially equal to the width dimension of the top lid panel;

a rear sidewall panel having four edges, a first of the four edges of the rear sidewall panel joining a first of the four edges of the top lid panel, a second of the four edges of the rear sidewall panel joining a first of the four edges of the bottom tray panel and opposite the first of the four edges of the rear sidewall panel, a third of the four edges of the rear sidewall panel extending at one end of the rear sidewall panel between the first and second edges of the rear sidewall panel, and a fourth of the four edges of the rear sidewall panel extending at an opposite end of the rear sidewall panel between the first and second edges of the rear sidewall panel;

the rear sidewall panel having a width dimension between the third and fourth of the four edges of the rear sidewall panel;

the width dimension of the rear sidewall panel being substantially equal to the width dimension of the top lid panel;

the rear sidewall panel having a height dimension "h" between the first and second of the four edges of the rear sidewall panel;

the height dimension of the rear sidewall panel being several times smaller than the width dimension of the rear sidewall panel;

a widthwise centerline defined on the rear sidewall panel at a position midway between the third and fourth of the four edges of the rear sidewall panel and extending between the first and second of the four edges of the rear sidewall panel;

a punch-out section formed by at least two lines of perforations through the blank of paperboard;

one of the at least two lines of perforations extending on one side of the widthwise centerline of the rear sidewall panel at least completely across the rear sidewall panel between the first and second of the four edges of the rear sidewall panel, and disposed towards the third of the four edges of the rear sidewall panel;

an other of the at least two lines of perforations extending on an opposite side of the widthwise centerline of the rear sidewall panel at least completely across the rear sidewall panel between the first and second of the four edges of the rear sidewall panel, and disposed towards the fourth of the four edges of the rear sidewall panel;

a widthwise distance between the one and the other of the lines of perforations being much smaller than the width dimension of the rear sidewall panel;

further comprising:

a plurality of weakening lines disposed on the rear sidewall panel facilitating folding an inter-folded pizza box formed from the blank;

wherein:

a first of the weakening lines extends from the first of the four edges of the rear sidewall panel to the second of the four edges of the rear sidewall panel at a location distant from and to one side of the widthwise centerline;

a second of the weakening lines extends from the first of the four edges of the rear sidewall panel to the second of the four edges of the rear sidewall panel at a location distant from and to the opposite side of the widthwise centerline;

a third of the weakening lines extends widthwise across the rear sidewall panel approximately parallel to and equidistant from the first and second of the four edges of the rear sidewall panel;

a fourth of the weakening lines extends from one end of the first of the weakening lines to an end of the third weakening line;

a fifth of the weakening lines extends from another end of the first of the weakening lines to the end of the third weakening line;

a sixth of the weakening lines extends from one end of the second of the weakening lines to an other end of the third weakening line;

a seventh of the weakening lines extends from another end of the second of the weakening lines to the other end of the third weakening line.

4. Pizza box blank, according to claim 3, wherein:

a portion of the rear sidewall panel defined by an area between the first, fourth and fifth of the weakening lines is triangular;

a portion of the rear sidewall panel defined by an area between the second, sixth and seventh of the weakening lines is triangular.

5. Pizza box blank, according to claim 4, wherein:

the portion of the rear sidewall panel defined by an area between the first, fourth and fifth of the weakening lines is approximately equilateral triangular;

the portion of the rear sidewall panel defined by an area between the second, sixth and seventh of the weakening lines is approximately equilateral triangular.

6. Pizza box blank, according to claim 3, wherein:

the third of the weakening lines extends dis-continuously across the punch-out section.

7. Pizza box blank, according to claim 3, wherein:

the first and second of the weakening lines are located about half the distance from the widthwise centerline to the respective side third and fourth of the four edges of the rear sidewall panel.

8. Pizza box blank, according to claim 3, wherein:

the widthwise distance between the one and the other of the lines of perforations being 8–13 times smaller than the width dimension of the rear sidewall panel.

9. Pizza box blank, according to claim 3, wherein:

the one and the other lines of perforations extend beyond the first of the four edges of the rear sidewall panel into the top lid panel, and intersect each other in the top lid panel at a position distant from the first edge of the top lid panel;

the one and the other lines of perforations extend beyond the second of the four edges of the rear sidewall panel into the bottom tray panel, and intersect each other in the bottom tray panel at a position distant from the first edge of the bottom tray panel.

10. Pizza box blank, according to claim 3, wherein:

a portion of the rear sidewall panel defined by two lines of perforations, the first of the four edges of the rear sidewall panel and the second of the four edges of the rear sidewall panel being rectangular.

11. Pizza box blank, according to claim 9, wherein:

a portion of the top lid panel defined by the one and the other lines of perforations extending into the top lid panel and the first edge of the top lid panel is triangular; and a portion of the bottom tray panel defined by the one and the other lines of perforations extending into the bottom tray panel and the first edge of the bottom tray panel is triangular.

12. Pizza box blank, according to claim 3, wherein:

a plurality of weakening lines disposed on the rear sidewall panel facilitating folding an inter-folded pizza box formed from the blank.

13. Pizza box blank for forming an interfolded pizza box, comprising;

a blank of paperboard;

a matrix of first pre-stressed lines on the blank defining:

a top lid panel having four edges, a length "l" between first two opposite of the four edges of the top lid panel, and a width dimension "w" between second two opposite of the four edges of the top lid panel;

a bottom tray panel having four edges, a length dimension between first two opposite of the four edges of the bottom tray panel and substantially equal to the length dimension of the top lid panel, and a width dimension between second two opposite of the four edges of the bottom tray panel and substantially equal to the width dimension of the top lid panel;

a rear sidewall panel having four edges, a first of the four edges of the rear sidewall panel joining a first of the four edges of the top lid panel, a second of the four edges of the rear sidewall panel joining a first of the four edges of the bottom tray panel and opposite the first of the four edges of the rear sidewall panel, a third of the four edges of the rear sidewall panel extending at one end of the rear sidewall panel between the first and second edges of the rear sidewall panel, and a fourth of the four edges of the rear sidewall panel extending at an opposite end of the rear sidewall panel between the first and second edges of the rear sidewall panel;

the rear sidewall panel having a width dimension between the third and fourth of the four edges of the rear sidewall panel;

the width dimension of the rear sidewall panel being substantially equal to the width dimension of the top lid panel;

the rear sidewall panel having a height dimension "h" between the first and second of the four edges of the rear sidewall panel;

the height dimension of the rear sidewall panel being several times smaller than the width dimension of the rear sidewall panel;

a widthwise centerline defined on the rear sidewall panel at a position midway between the third and fourth of the four edges of the rear sidewall panel and extending between the first and second of the four edges of the rear sidewall panel;

a first punch-out section formed by first at least two lines of perforations through the blank of paperboard;

a second punch-out section formed by second at least two lines of perforations through the blank of paperboard;

the first punch-out section is disposed to one side of the widthwise centerline of the rear sidewall panel;

the second punch-out section is disposed to an other side of the widthwise centerline of the rear sidewall panel;

the first at least two lines of perforations extend at least completely across the rear sidewall panel between the first and second of the four edges of the rear sidewall panel;

the second at least two lines of perforations extend at least completely across the rear sidewall panel between the first and second of the four edges of the rear sidewall panel;

a first weakening line extending across the rear sidewall panel between the first and second of the four edges of the rear sidewall panel;

a second weakening line extending across the rear sidewall panel between the first and second of the four edges of the rear sidewall panel;

the first punch-out section defined by the first at least two lines of perforations and the first weakening line, and extending widthwise across the rear sidewall panel a distance much smaller than the width dimension of the rear sidewall panel; and the second punch-out section defined by the second at least two lines of perforations and the second weakening line, and extending widthwise across the rear sidewall panel a distance much smaller than the width dimension of the rear sidewall panel;

wherein:

the first punch-out section is approximately triangular; and the second punch-out section is approximately triangular.

14. Pizza box blank, according to claim 13, wherein:

the first punch-out section is disposed approximately three-quarter of the distance from the widthwise centerline of the rear sidewall panel to a one end of the rear sidewall panel; and the second punch-out section is disposed approximately three-quarter of the distance from the widthwise centerline of the rear sidewall panel to an opposite end of the rear sidewall panel.

15. Pizza box blank for forming an inter-folded pizza box, comprising:

a blank of paperboard;

a matrix of first pre-stressed lines on the blank defining:

a top lid panel having four edges, a length dimension "l" between first two opposite of the four edges of the top lid panel, and a width dimension "w" between second two opposite of the four edges of the top lid panel;

a bottom tray panel having four edges, a length dimension between first two opposite of the four edges of the bottom tray panel and substantially equal to the length dimension of the to lid panel, and a width dimension between second two opposite of the four edges of the bottom tray panel and substantially equal to the width dimension of the top lid panel;

a rear sidewall panel having four edges, a first of the four edges of the rear sidewall panel joining a first of the four edges of the top lid panel, a second of the four edges of the rear sidewall panel joining a first of the four edges of the bottom tray panel and opposite the first of the four edges of the rear sidewall panel, a third of the four edges of the rear sidewall panel extending at one end of the rear sidewall panel between the first and second edges of the rear sidewall panel, and a fourth of the four edges of the rear sidewall panel extending at an opposite end of the rear sidewall panel between the first and second edges of the rear sidewall panel;

the rear sidewall panel having a width dimension between the third and fourth of the four edges of the rear sidewall panel;

the width dimension of the rear sidewall panel being substantially equal to the width dimension of the top lid panel;

the rear sidewall panel having a height dimension "h" between the first and second of the four edges of the rear sidewall panel;

the height dimension of the rear sidewall panel being several times smaller than the width dimension of the rear sidewall panel;

a widthwise centerline defined on the rear sidewall panel at a position midway between the third and fourth of the four edges of the rear sidewall panel and extending between the first and second of the four edges of the rear sidewall panel;

a first punch-out section formed by first at least two lines of perforations through the blank of paperboard;

a second punch-out section formed by second at least two lines of perforations through the blank of paperboard;

the first punch-out section is disposed to one side of the widthwise centerline of the rear sidewall panel;

the second punch-out section is disposed to an other side of the widthwise centerline of the rear sidewall panel;

the first at least two lines of perforations extend at least completely across the rear sidewall panel between the first and second of the four edges of the rear sidewall panel;

the second at least two lines of perforations extend at least completely across the rear sidewall panel between the first and second of the four edges of the rear sidewall panel;

a first weakening line extending across the rear sidewall panel between the first and second of the four edges of the rear sidewall panel;

a second weakening line extending across the rear sidewall panel between the first and second of the four edges of the rear sidewall panel;

the first punch-out section defined by the first at least two lines of perforations and the first weakening line, and extending widthwise across the rear sidewall panel a distance much smaller than the width dimension of the rear sidewall panel; and the second punch-out section defined by the second at least two lines of perforations and the second weakening line, and extending widthwise across the rear sidewall panel a distance much smaller than the width dimension of the rear sidewall panel;

further comprising:

a third weakening line extending widthwise across the rear sidewall panel between the first and the second punch-out sections.

16. Pizza box blank, according to claim 15, wherein:

the first punch-out section is disposed approximately three-quarter of the distance from the widthwise centerline of the rear sidewall panel to a one end of the rear sidewall panel; and the second punch-out section is disposed approximately three-quarter of the distance from the widthwise centerline of the rear sidewall panel to an opposite end of the rear sidewall panel.

* * * * *